US007736447B2

(12) United States Patent
Asahi et al.

(10) Patent No.: US 7,736,447 B2
(45) Date of Patent: Jun. 15, 2010

(54) STEEL PLATES FOR ULTRA-HIGH-STRENGTH LINEPIPES AND ULTRA-HIGH-STRENGTH LINEPIPES HAVING EXCELLENT LOW-TEMPERATURE TOUGHNESS AND MANUFACTURING METHODS THEREOF

(75) Inventors: Hitoshi Asahi, Futtsu (JP); Takuya Hara, Futtsu (JP)

(73) Assignees: Nippon Steel Corporation, Tokyo (JP); Exxonmobil Upstream Research Company, Houston, TX (US)

( * ) Notice: Subject to any disclaimer, the term of this patent is extended or adjusted under 35 U.S.C. 154(b) by 356 days.

(21) Appl. No.: 10/582,830

(22) PCT Filed: Dec. 17, 2004

(86) PCT No.: PCT/JP2004/019468

§ 371 (c)(1),
(2), (4) Date: Jun. 14, 2006

(87) PCT Pub. No.: WO2005/061749

PCT Pub. Date: Jul. 7, 2005

(65) Prior Publication Data

US 2007/0125462 A1 Jun. 7, 2007

(30) Foreign Application Priority Data

Dec. 19, 2003 (JP) ..... 2003-423329

(51) Int. Cl.

| | |
|---|---|
| ***C22C 38/12*** | (2006.01) |
| ***C22C 38/14*** | (2006.01) |
| ***C22C 38/04*** | (2006.01) |
| ***C21D 8/02*** | (2006.01) |
| ***C21D 8/10*** | (2006.01) |

(52) U.S. Cl. ..... 148/320; 148/330; 148/331; 148/332; 148/333; 148/334; 148/335; 148/336; 148/590; 148/593; 148/519; 148/521; 148/654

(58) Field of Classification Search ..... 148/320, 148/330–336, 590, 593, 519–521, 654
See application file for complete search history.

(56) References Cited

U.S. PATENT DOCUMENTS 4,591,396 A * 5/1986 Mazuda et al. ..... 148/505

(Continued)

FOREIGN PATENT DOCUMENTS

CA 2429439 11/2003

(Continued)

OTHER PUBLICATIONS

H.K.D.H. Bhadeshia, "Bainite in Steels, Transformations, Microstructure and Properties" (The University Press, Cambridge, 2001), second edition, p. 190.

(Continued)

*Primary Examiner*—Deborah Yee
(74) *Attorney, Agent, or Firm*—Kenyon & Kenyon LLP

(57) ABSTRACT

Ultra-high-strength linepipes having excellent low-temperature toughness manufactured by welding together the edges of steel plates comprising C of 0.03 to 0.07 mass %, Si of not more than 0.6 mass %, Mn of 1.5 to 2.5 mass %, P of not more than 0.015 mass %, S of not more than 0.003 mass %, Ni of 0.1 to 1.5 mass %, Mo of 0.15 to 0.60 mass %, Nb of 0.01 to 0.10 mass %, Ti of 0.005 to 0.030 mass %, Al of not more than 0.06 mass %, one or more of required amounts of B, N, V, Cu, Cr, Ca, REM (rare-earth metals) and Mg, with the remainder consisting of iron and unavoidable impurities and having a (Hv-ave)/(Hv-M) ratio between 0.8 and 0.9 at $2.5 \leqq P \leqq 4.0$, wherein Hv-ave is the average Vickers hardness in the direction of the thickness of the base metal and Hv-M is the martensite hardness depending on C-content (Hv-M=270+1300C) and a tensile strength TS-C between 900 MPa and 1100 MPa; $P=2.7C+0.4Si+Mn+0.8Cr+0.45(Ni+Cu)+(1+\beta)Mo-1+\beta$ ($\beta=1$ when $B \geqq 3$ ppm and $\beta=0$ when $B<3$ ppm).

22 Claims, 3 Drawing Sheets

U.S. PATENT DOCUMENTS

| | | | | |
|---|---|---|---|---|
| 5,061,325 | A | | 10/1991 | Okamura et al. |
| 5,634,988 | A | * | 6/1997 | Kurebayashi et al. ..... 148/320 |

FOREIGN PATENT DOCUMENTS

| | | |
|---|---|---|
| EP | 0753596 | 1/1997 |
| EP | 0757113 | 2/1997 |
| EP | 1020539 | 7/2000 |
| EP | 1541252 | 6/2005 |
| JP | 10306347 | 11/1998 |
| JP | 10306348 | 11/1998 |
| JP | 11172330 | 6/1999 |
| JP | 11172374 | 6/1999 |
| JP | 2000199036 | 7/2000 |
| JP | 2004052104 | 2/2004 |
| WO | WO 99/05335 | 2/1999 |
| WO | WO 99/32670 | 7/1999 |
| WO | WO 03/099482 | 12/2003 |

OTHER PUBLICATIONS

"Metals Handbook, Properties and Selection: Irons, Steels, and High-Performance Alloys" (ASM Int'l, 1990), tenth edition, vol. 1, p. 129.

* cited by examiner

STEEL PLATES FOR ULTRA-HIGH-STRENGTH LINEPIPES AND ULTRA-HIGH-STRENGTH LINEPIPES HAVING EXCELLENT LOW-TEMPERATURE TOUGHNESS AND MANUFACTURING METHODS THEREOF

TECHNICAL FIELD

The present invention relates to ultra-high-strength linepipes with excellent low-temperature toughness and having a circumferential tensile strength (TS-C) of not lower than 900 MPa for use as pipelines for transportation of crude oil, natural gas, etc.

BACKGROUND ART

Recently pipelines have been acquiring increasing importance as long distance transportation means for crude oil, natural gas, etc. Up to now the American Petroleum Institute (API) Standards X80 and below have been applied to long-distance transportation main linepipes. However, higher-strength linepipes are required for (1) the improvement of transportation efficiency through increase of transportation pressure and (2) the improvement of laying efficiency through reduction of linepipe diameter and weight.

Particularly X120 grade linepipes having a tensile strength of 900 MPa or more and being capable of withstanding approximately twice as much internal pressure as X65 can transport approximately twice as much gas as same size linepipes of lower grades. Compared with methods which increase linepipes' pressure carrying capacity by increasing pipe wall thickness, the use of higher-strength linepipes realizes large savings in pipeline construction cost by saving costs of material, transportation and field welding work.

As has been already disclosed in Japanese Unexamined Patent Publication (Kokai) No. 2000-199036, development of X120 linepipes, whose base material microstructure consists principally of a martensite/bainite mixture (lower bainite), is under way. However, the manufacture of this linepipe involves severe process constraints because extremely precise and strict microstructural control is required.

Increasing the strength of linepipes also necessitates increasing the strength of weld metal formed in joints between pipes field-welded (hereinafter referred to as field welds) in pipeline construction.

Generally the low-temperature toughness of the weld metal of welded joints is lower than that of the base metal and decreases further when the strength increases. Therefore, increasing the strength of linepipes necessitates increasing the strength of the weld metal of field welds, which leads to a lowering of low-temperature toughness.

If the strength of the weld metal of field welds is lower than the longitudinal strength of linepipe, strain concentrates in the field welds when stress occurs in the longitudinal direction of pipeline, thereby increasing the fracture susceptibility in heat-affected zone.

In ordinary pipelines, internal pressure generates circumferential stress but develops no longitudinal stress. However, in pipelines built in regions, such as discontinuous tundras, where the ground moves due to the actions of freezing and thawing, the movement of the ground bends pipelines and develops longitudinal stress.

That is, the weld metal of field welds of pipelines must have greater strength than the strength in the longitudinal direction of the pipe. However, the weld metal of field welds of the ultra-high-strength linepipes to which the present invention relates already has high strength. Therefore, further strengthening brings about a sharp decrease in toughness.

Accordingly, this problem will be relieved if the strength in the longitudinal direction of pipe that has no relation to the strength to withstand internal pressure is decreased while maintaining the strength in the circumferential direction of pipe.

The high-strength steel pipe the inventor proposed in Japanese Unexamined Patent Publication (Kokai) No. 2004-052104 differs in microstructure from the pipe according to this invention. This structural difference is due to differences in the amount of processing in the uncrystallized region and manufacturing conditions.

SUMMARY OF THE INVENTION

The present invention provides ultra-high-strength linepipes that are suited for pipelines built in regions, such as discontinuous tundras, where the ground moves with the season and is capable of making low-temperature toughness of field welds and longitudinal buckle resistance of pipes, compatible.

To be more specific, the present invention provides ultra-high-strength linepipes having a circumferential tensile strength (TS-C) of not lower than 900 MPa (equivalent to API X120) by lowering only the tensile strength in the longitudinal direction thereof and methods for manufacturing such linepipes. The present invention also provides steel plates for the manufacture of the ultra-high-strength linepipes and methods for manufacturing such steel plates.

In order to obtain ultra-high-strength linepipes having a circumferential tensile strength of not lower than 900 MPa without increasing the longitudinal tensile strength thereof, the inventor studied the requirements the steel plates must satisfy.

The study led to the invention of steel plates for the manufacture of ultra-high-strength linepipes having excellent pressure carrying capacity, low-temperature toughness and buckle resistance and methods for manufacturing such steel plates and further to the invention of linepipes made of such steel plates and methods for manufacturing such linepipes.

The gist of the invention is as follows:

(1) Steel plate for ultra-high-strength linepipe having excellent low-temperature toughness consisting of:

| | |
|---|---|
| C | 0.03 to 0.07 mass % |
| Si | not more than 0.6 mass % |
| Mn | 1.5 to 2.5 mass % |
| P | not more than 0.015 mass % |
| S | not more than 0.003 mass % |
| Mo | 0.15 to 0.60 mass % |
| Nb | 0.01 to 0.10 mass % |
| Ti | 0.005 to 0.030 mass % |
| Al | not more than 0.10 mass % |
| and, one or more of | |
| Ni | 0.1 to 1.5 mass % |
| B | less than 3 ppm |
| V | not more than 0.10 mass % |
| Cu | not more than 1.0 mass % |
| Cr | not more than 1.0 mass % |
| Ca | not more than 0.01 mass % |
| REM | not more than 0.02 mass % |
| Mg | not more than 0.006 mass % |

and the remainder consisting of iron and unavoidable impurities and having the value P defined below being between 2.5 and 4.0, in which;

the ratio (Hv-ave$_p$)/(Hv-M) between the average Vickers hardness Hv-ave$_p$ in the direction of thickness and the martensitic hardness Hv-M determined by carbon content is between 0.8 and 0.9, and the transverse tensile strength TS-T$_p$ is between 880 MPa and 1080 MPa, $$P=2.7C+0.4Si+Mn+0.8Cr+0.45(Ni+Cu)+Mo-1$$

$$Hv\text{-}M=270+1300C$$

wherein the symbols of elements designate the mass % of the individual elements.

(2) Steel plate for ultra-high-strength linepipe having excellent low-temperature toughness consisting of:

| | |
|---|---|
| C | 0.03 to 0.07 mass % |
| Si | not more than 0.6 mass % |
| Mn | 1.5 to 2.5 mass % |
| P | not more than 0.015 mass % |
| S | not more than 0.003 mass % |
| Mo | 0.15 to 0.60 mass % |
| Nb | 0.01 to 0.10 mass % |
| Ti | 0.005 to 0.030 mass % |
| Al | not more than 0.10 mass % |
| B | 3 ppm to 0.0025 mass % |
| and, one or more of | |
| Ni | 0.1 to 1.5 mass % |
| N | 0.001 to 0.006 mass % |
| V | not more than 0.10 mass % |
| Cu | not more than 1.0 mass % |
| Cr | not more than 1.0 mass % |
| Ca | not more than 0.01 mass % |
| REM | not more than 0.02 mass % |
| Mg | not more than 0.006 mass % |

and the remainder consisting of iron and unavoidable impurities and having the value P defined below being between 2.5 and 4.0, in which;

the ratio (Hv-ave$_p$)/(Hv-M) between the average Vickers hardness Hv-ave$_p$ in the direction of thickness and the martensitic hardness Hv-M determined by carbon content is between 0.8 and 0.9, and the transverse tensile strength TS-T$_p$ is between 880 MPa and 1080 MPa, $$P=2.7C+0.4Si+Mn+0.8Cr+0.45(Ni+Cu)+2Mo$$

$$Hv\text{-}M=270+1300C$$

wherein the symbols of elements designate the mass % of the individual elements.

(3) Steel plate for ultra-high-strength linepipe having excellent low-temperature toughness described in (1) or (2), containing:

N: 0.001 to 0.006 mass %.

(4) Steel plate for ultra-high-strength linepipe having excellent low-temperature toughness described in (3), in which the relationship Ti−3.4 N>0 is satisfied (wherein the symbols of elements designate the mass % of the individual elements).

(5) Steel plate for ultra-high-strength linepipe having excellent low-temperature toughness described in any of (1) to (4), in which the V-notch Charpy value at −20° C. is not lower than 200 J.

(6) Steel plate for ultra-high-strength linepipe having excellent low-temperature toughness described in any of (1) to (5), in which the longitudinal tensile strength TS-L$_p$ is not greater than 0.95 times the transverse tensile strength TS-T$_p$.

(7) Steel plate for ultra-high-strength linepipe having excellent low-temperature toughness described in any of (1) to (6), in which the yield ratio in the direction of rolling (YS-L$_p$)/(TS-L$_p$), which is the ratio of the 0.2% offset yield strength YS-L$_p$ in the direction of rolling to the tensile strength TS-L$_p$ in the direction of rolling is not greater than 0.8.

(8) Ultra-high-strength linepipe having excellent low-temperature toughness prepared by seam-welding steel plate consisting of:

| | |
|---|---|
| C | 0.03 to 0.07 mass % |
| Si | not more than 0.6 mass % |
| Mn | 1.5 to 2.5 mass % |
| P | not more than 0.015 mass % |
| S | not more than 0.003 mass % |
| Ni | 0.1 to 1.5 mass % |
| Mo | 0.15 to 0.60 mass % |
| Nb | 0.01 to 0.10 mass % |
| Ti | 0.005 to 0.030 mass % |
| Al | not more than 0.06 mass % |
| and, one or more of | |
| B | not more than 0.0025 mass % |
| N | 0.001 to 0.006 mass % |
| V | not more than 0.10 mass % |
| Cu | not more than 1.0 mass % |
| Cr | not more than 1.0 mass % |
| Ca | not more than 0.01 mass % |
| REM | not more than 0.02 mass % |
| Mg | not more than 0.006 mass % |

and the remainder consisting of iron and unavoidable impurities and having the value P defined below being between 2.5 and 4.0, in which;

the ratio (Hv-ave)/(Hv-M) between the average Vickers hardness Hv-ave in the direction of thickness of the base metal and the martensitic hardness Hv-M determined by carbon content is between 0.8 and 0.9, and the circumferential tensile strength TS-C is between 900 MPa and 1100 MPa, $$P=2.7C+0.4Si+Mn+0.8Cr+0.45(Ni+Cu)+(1+\beta)Mo-1+\beta$$

where $\beta=1$ when $B\geqq 3$ ppm and $\beta=0$ when $B<3$ ppm $$Hv\text{-}M=270+1300C$$

wherein the symbols of elements designate the mass % of the individual elements.

(9) Ultra-high-strength linepipe having excellent low-temperature toughness prepared by seam-welding steel plate consisting of:

| | |
|---|---|
| C | 0.03 to 0.07 mass % |
| Si | not more than 0.6 mass % |
| Mn | 1.5 to 2.5 mass % |
| P | not more than 0.015 mass % |
| S | not more than 0.003 mass % |
| Mo | 0.15 to 0.60 mass % |
| Nb | 0.01 to 0.10 mass % |
| Ti | 0.005 to 0.030 mass % |
| Al | not more than 0.10 mass % |
| and, one or more of | |
| Ni | 0.1 to 1.5 mass % |
| B | less than 3 ppm |
| V | not more than 0.10 mass % |
| Cu | not more than 1.0 mass % |
| Cr | not more than 1.0 mass % |
| Ca | not more than 0.01 mass % |
| REM | not more than 0.02 mass % |
| Mg | not more than 0.006 mass % |

and the remainder consisting of iron and unavoidable impurities and having the value P defined below being between 2.5 and 4.0, in which;

the ratio (Hv-ave)/(Hv-M*) between the average Vickers hardness Hv-ave in the direction of thickness of the base metal and the martensitic hardness Hv-M* determined by carbon content is between 0.75 and 0.9, and the circumferential tensile strength TS-C is between 900 MPa and 1100 MPa, $$P=2.7C+0.4Si+Mn+0.8Cr+0.45\ (Ni+Cu)+Mo-1$$

$$Hv\text{-}M^*=290+1300C$$

wherein the symbols of elements designate the mass % of the individual elements.

(10) Ultra-high-strength linepipe having excellent low-temperature toughness prepared by seam-welding steel plate consisting of:

| | |
|---|---|
| C | 0.03 to 0.07 mass % |
| Si | not more than 0.6 mass % |
| Mn | 1.5 to 2.5 mass % |
| P | not more than 0.015 mass % |
| S | not more than 0.003 mass % |
| Mo | 0.15 to 0.60 mass % |
| Nb | 0.01 to 0.10 mass % |
| Ti | 0.005 to 0.030 mass % |
| Al | not more than 0.10 mass % |
| B | 3 ppm to 0.0025 mass % |
| and, one or more of | |
| Ni | 0.1 to 1.5 mass % |
| N | 0.001 to 0.006 mass % |
| V | not more than 0.10 mass % |
| Cu | not more than 1.0 mass % |
| Cr | not more than 1.0 mass % |
| Ca | not more than 0.01 mass % |
| REM | not more than 0.02 mass % |
| Mg | not more than 0.006 mass % |

and the remainder consisting of iron and unavoidable impurities and having the value P defined below being between 2.5 and 4.0, in which;

the ratio (Hv-ave)/(Hv-M*) between the average Vickers hardness Hv-ave in the direction of thickness of the base metal and the martensitic hardness Hv-M* determined by carbon content is between 0.75 and 0.9, and the circumferential tensile strength TS-C is between 900 MPa and 1100 MPa, $$P=2.7C+0.4Si+Mn+0.8Cr+0.45(Ni+Cu)+2Mo$$

$$Hv\text{-}M^*=290+1300C$$

wherein the symbols of elements designate the mass % of the individual elements.

(11) Ultra-high-strength linepipe having excellent low-temperature toughness described in (9) or (10) containing:

N: 0.001 to 0.006 mass %.

(12) Ultra-high-strength linepipe having excellent low-temperature toughness described in (11), in which the relationship $Ti-3.4\ N>0$ is satisfied (wherein the symbols of elements designate the mass % of the individual elements).

(13) Ultra-high-strength linepipe having excellent low-temperature toughness described in any of (8) to (12), in which the V-notch Charpy value at −20° C. is not lower than 200 J.

(14) Ultra-high-strength linepipe having excellent low-temperature toughness described in any of (8) to (13), in which the tensile strength in the longitudinal direction of linepipe is not greater than 0.95 times the tensile strength in the circumferential direction thereof.

(15) A method for manufacturing steel plate for ultra-high-strength linepipe having excellent low-temperature toughness comprising the steps of:

heating slabs consisting of:

| | |
|---|---|
| C | 0.03 to 0.07 mass % |
| Si | not more than 0.6 mass % |
| Mn | 1.5 to 2.5 mass % |
| P | not more than 0.015 mass % |
| S | not more than 0.003 mass % |
| Mo | 0.15 to 0.60 mass % |
| Nb | 0.01 to 0.10 mass % |
| Ti | 0.005 to 0.030 mass % |
| Al | not more than 0.10 mass % |
| and, one or more of | |
| Ni | 0.1 to 1.5 mass % |
| B | less than 3 ppm |
| V | not more than 0.10 mass % |
| Cu | not more than 1.0 mass % |
| Cr | not more than 1.0 mass % |
| Ca | not more than 0.01 mass % |
| REM | not more than 0.02 mass % |
| Mg | not more than 0.006 mass % |

and the remainder consisting of iron and unavoidable impurities and having the value P defined below being between 2.5 and 4.0 and between 1000 and 1250° C., rough rolling in a recrystallizing region, rolling in an unrecrystallization austenitic region at 900° C. or below with a cumulative rolling reduction of not less than 75% and, then, applying accelerated cooling from the austenitic region so that the center of plate thickness cools to 500° C. or below at a rate of 1 to 10° C./sec., $$P=2.7C+0.4Si+Mn+0.8Cr+0.45(Ni+Cu)+Mo-1$$

wherein the symbols of elements designate the mass % of the individual elements.

(16) A method for manufacturing steel plate for ultra-high-strength linepipe having excellent low-temperature toughness comprising the steps of:

heating slabs consisting of:

| | |
|---|---|
| C | 0.03 to 0.07 mass % |
| Si | not more than 0.6 mass % |
| Mn | 1.5 to 2.5 mass % |
| P | not more than 0.015 mass % |
| S | not more than 0.003 mass % |
| Mo | 0.15 to 0.60 mass % |
| Nb | 0.01 to 0.10 mass % |
| Ti | 0.005 to 0.030 mass % |
| Al | not more than 0.10 mass % |
| B | 3 ppm to 0.0025 mass % |
| and, one or more of | |
| Ni | 0.1 to 1.5 mass % |
| N | 0.001 to 0.006 mass % |
| V | not more than 0.10 mass % |
| Cu | not more than 1.0 mass % |
| Cr | not more than 1.0 mass % |
| Ca | not more than 0.01 mass % |
| REM | not more than 0.02 mass % |
| Mg | not more than 0.006 mass % |

and the remainder consisting of iron and unavoidable impurities and having the value P defined below being between 2.5 and 4.0 and between 1000 and 1250° C., rough rolling in a recrystallized region, rolling in an unrecrystallization austenitic region at 900° C. or below with a cumulative rolling reduction of not less than 75% and, then, applying accelerated cooling from the austenitic region so that the center of plate thickness cools to 500° C. or below at a rate of 1 to 10° C./sec., $$P=2.7C+0.4Si+Mn+0.8Cr+0.45(Ni+Cu)+2Mo$$

wherein the symbols of elements designate the mass % of the individual elements.

(17) A method for manufacturing steel plate for ultra-high-strength linepipe having excellent low-temperature toughness described in (15) or (16), in which slabs also contain N: 0.001 to 0.006 mass %.

(18) A method for manufacturing steel plate for ultra-high-strength linepipe having excellent low-temperature toughness described in (17), in which the relationship Ti−3.4 N>0 is satisfied (wherein the symbols of elements designate the mass % of the individual elements).

(19) A method for manufacturing ultra-high-strength linepipe having excellent low-temperature toughness comprising the steps of:

forming a steel plate manufactured by the methods for manufacturing ultra-high-strength steel plate having excellent low-temperature toughness described in any of (15) to (18) into a pipe form so that the rolling direction of the steel plate agrees with the longitudinal direction of a pipe to be manufactured and forming a pipe by seam-welding together the edges thereof.

(20) A method for manufacturing ultra-high-strength linepipe having excellent low-temperature toughness comprising the steps of:

forming a steel plate manufactured by the methods for manufacturing ultra-high-strength steel plate having excellent low-temperature toughness described in any of (15) to (18) into a pipe form by the UO process so that the rolling direction of the steel plate agrees with the longitudinal direction of a pipe to be manufactured, forming a pipe by joining together the edges thereof by applying submerged-arc welding from both inside and outside, and expanding the welded pipe.

(21) A method for manufacturing ultra-high-strength linepipe having excellent low-temperature toughness comprising the steps of:

heating slabs consisting of:

| | |
|---|---|
| C | 0.03 to 0.07 mass % |
| Si | not more than 0.6 mass % |
| Mn | 1.5 to 2.5 mass % |
| P | not more than 0.015 mass % |
| S | not more than 0.003 mass % |
| Ni | 0.1 to 1.5 mass % |
| Mo | 0.15 to 0.60 mass % |
| Nb | 0.01 to 0.10 mass % |
| Ti | 0.005 to 0.030 mass % |
| Al | not more than 0.06 mass % |
| and, one or more of | |
| B | not more than 0.0025 mass % |
| N | 0.001 to 0.006 mass % |
| V | not more than 0.10 mass % |
| Cu | not more than 1.0 mass % |
| Cr | not more than 1.0 mass % |
| Ca | not more than 0.01 mass % |
| REM | not more than 0.02 mass % |
| Mg | not more than 0.006 mass % |

and the remainder consisting of iron and unavoidable impurities and having the value P defined below being between 2.5 and 4.0 and between 1000 and 1250° C., rough rolling in a recrystallized region, rolling in an unrecrystallization austenitic region at 900° C. or below with a cumulative rolling reduction of not less than 75%, applying accelerated cooling from the austenitic region so that the center of plate thickness cools to 500° C. or below at a rate of 1 to 10° C./sec., forming the steel plate thus manufactured into a pipe form so that the rolling direction of the steel plate agrees with the longitudinal direction of a pipe to be manufactured, and forming a pipe by welding together the edges thereof.

$$P=2.7C+0.4Si+Mn+0.8Cr+0.45(Ni+Cu)+(1+\beta)Mo-1+\beta$$

where $\beta=1$ when $B\geqq 3$ ppm and $\beta=0$ when $B<3$ ppm wherein the symbols of elements designate the mass % of the individual elements.

(22) A method for manufacturing ultra-high-strength linepipe having excellent low-temperature toughness described in (21), which furthermore comprising the steps of:

forming the steel plate subjected to accelerated cooling into a pipe form by the UO process so that the rolling direction of the steel plate agrees with the longitudinal direction of a pipe to be manufactured, joining the edges thereof together by applying submerged-arc welding from both inside and outside, and expanding the welded pipe.

THE MOST PREFERRED EMBODIMENT

To secure the strength to withstand fracture caused by the stress built up in the longitudinal direction of pipeline, the strength of field weld must be equal to or greater than the longitudinal strength of pipeline.

If the longitudinal strength of pipeline is larger than the strength of field weld, the probability decreases that field weld deforms locally and, then, fractures. If, on the other hand, the longitudinal strength of pipeline is too great, increasing the strength of field weld lowers the low-temperature toughness.

In order to solve this problem, the inventor started to develop an ultra-high-strength linepipe having a circumferential tensile strength (TS-C) of not lower than 900 MPa and a reduced longitudinal tensile strength (TS-L).

By investigating the relationship between the microstructure of steel plate for ultra-high-strength linepipe and the strength of steel plate in the directions of rolling and transverse, the inventor discovered that longitudinal tensile strength (tensile strength longitudinal to the rolling direction)

of steel plate can be effectively reduced by transforming the microstructure thereof into a degenerate upper bainite structure.

In addition, tensile strength transverse to the rolling direction is described as transverse tensile strength.

Here, degenerate upper bainite structure means a structure that has a lath structure characteristic of low-temperature transformation structures and forms carbides and martensite-austenite (MA) constituents of the second phase coarser than those in lower bainite.

Figure 1:
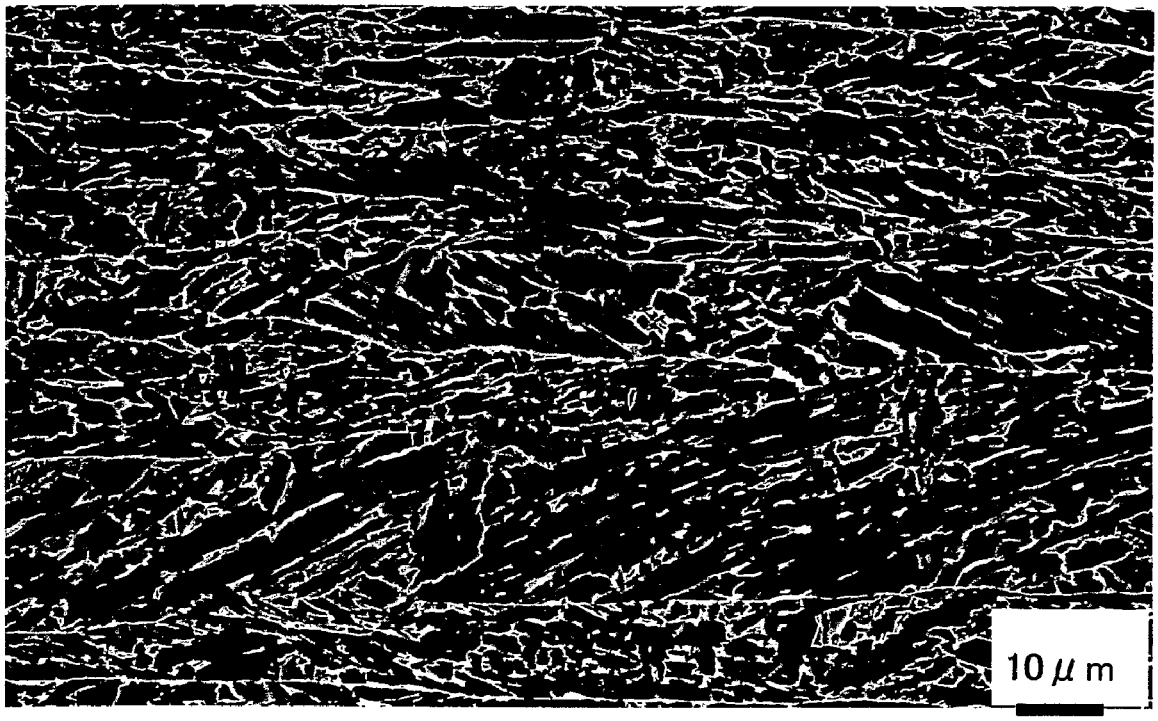
FIG. 1 shows a degenerate upper bainite structure.

FIG. 1 shows a scanning electron micrograph of steel plate for ultra-high-strength linepipe having a microstructure of degenerate upper bainite according to the present invention. For the purpose of comparison, FIG. 2 shows a scanning electron micrograph of steel plate for conventional X120 grade linepipe having a mixed microstructure of martensite and bainite (hereinafter referred to as the lower bainite structure).

Figure 2:
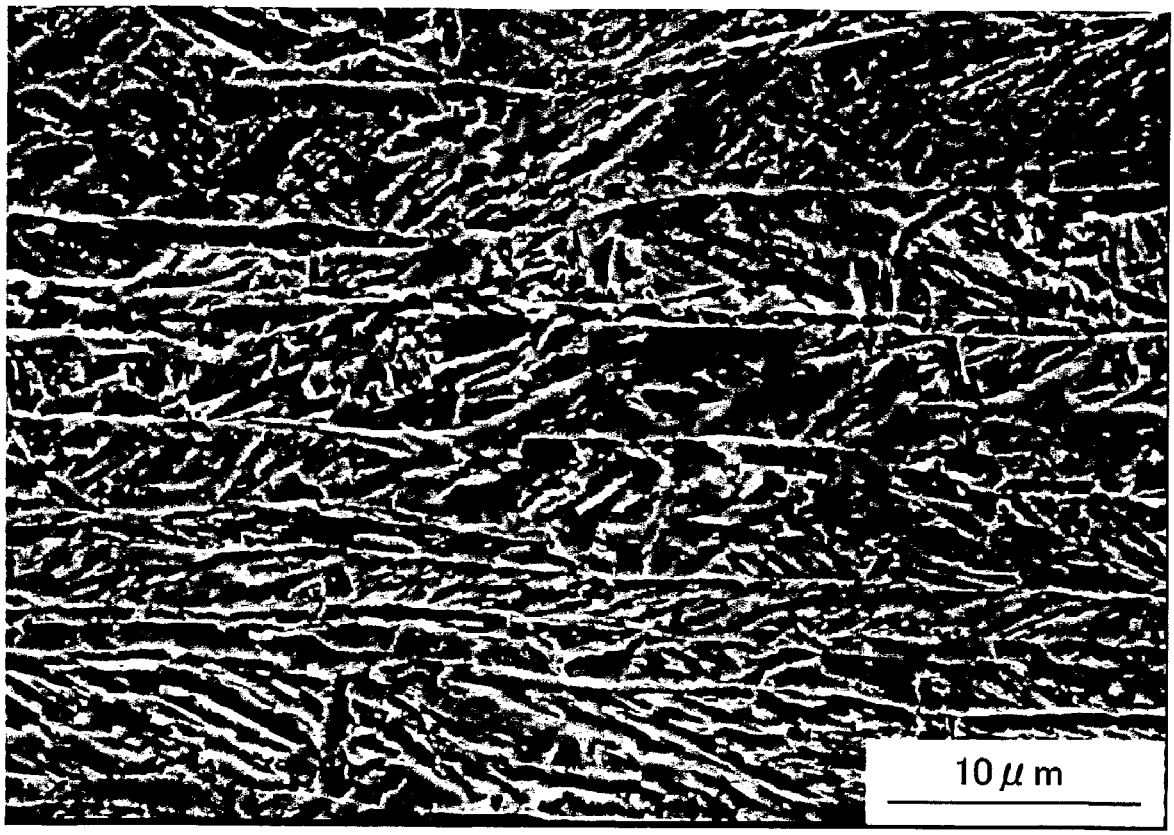
FIG. 2 shows a mixed martensite/bainite (lower bainite) structure.
Figure 3:
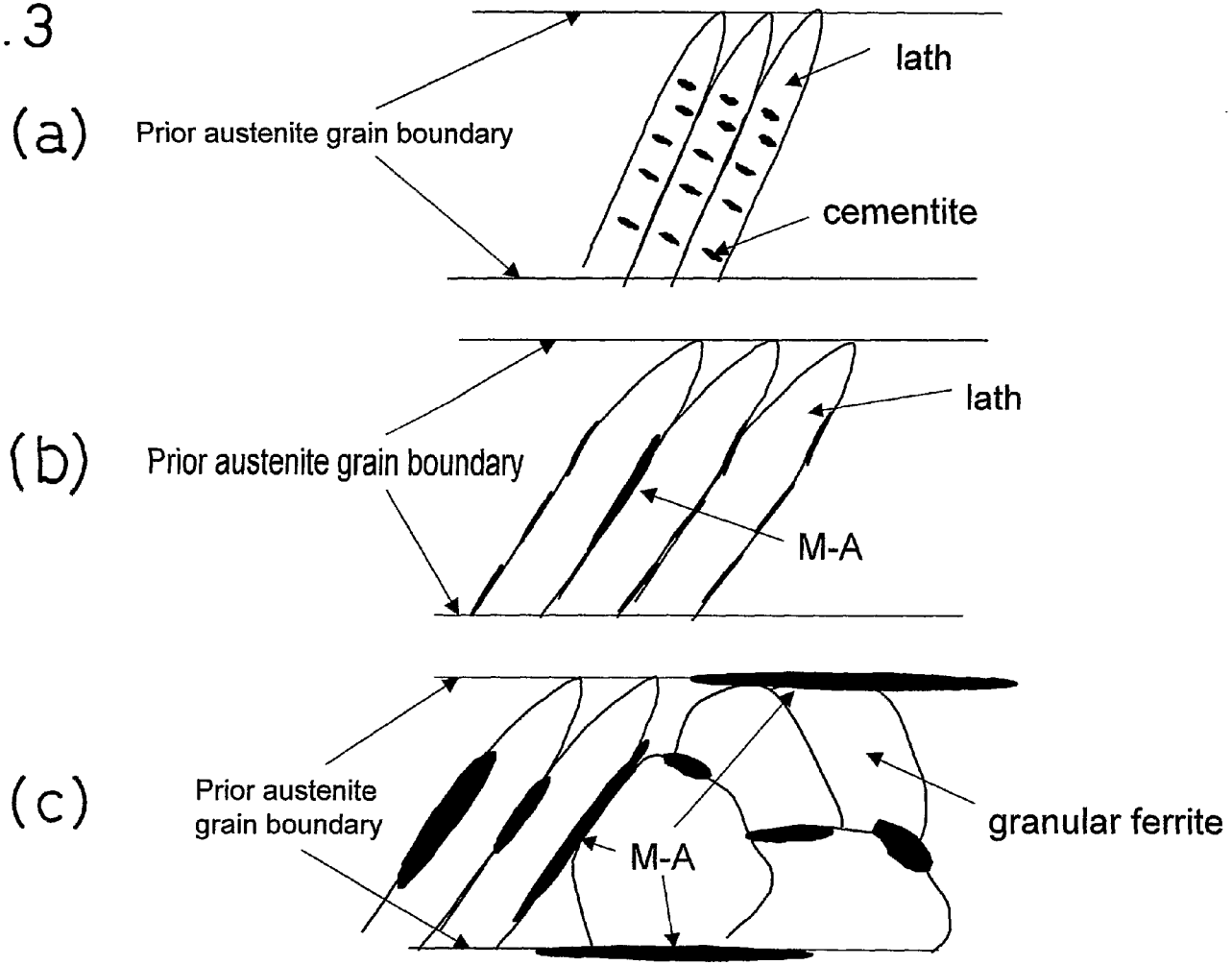
FIG. 3 schematically shows a lower bainite, degenerate upper bainite and granular bainite structure. (a) shows lower bainite, (b) shows degenerate upper bainite, and (c) shows granular bainite.

As comparison between the scanning electron micrographs in FIGS. 1 and 2 does not clarify the microstructural difference between degenerate upper bainite and lower bainite structures, FIG. 3 shows schematic illustrations.

As shown in FIG. 3(*b*), the laths in degenerate upper bainite are wider than that in lower bainite (see FIG. 3(*a*)) and do not contain, unlike lower bainite, fine cementite therein and have MA constituents between laths.

Comparison between degenerate upper bainite and granular bainite (see FIG. 3(*c*)) reveals that granular bainite has coarser MA constituents than degenerate upper bainite has and, unlike degenerate upper bainite, contains granular ferrite.

While degenerate upper bainite can be distinguished from lower bainite by scanning electron microscopy, it is difficult to determine the quantitative proportion therebetween by microstructural photograph. In this invention, therefore, degenerate upper bainite and lower bainite are distinguished by comparing Vickers hardness by taking advantage of the fact that degenerate upper bainite is not as hard as lower bainite.

With the chemical composition of the steels according to this invention, the hardness of lower bainite is equal to the hardness of martensite Hv-M that depends on carbon content.

Hv-M of steel plate can be derived from the following equation:

$$\text{Hv-M}=270+1300C$$

If degenerate upper bainite in the microstructure of steel plate exceeds approximately 70%, the hardness of steel plate Hv-ave$_p$ becomes lower than Hv-M and the ratio (Hv-ave$_p$)/(Hv-M) falls in the range between 0.8 and 0.9.

The hardness of steel plate Hv-ave$_p$ is the average of hardness measured by applying a load of 10 kgf at intervals of 1 mm across the thickness thereof in the cross-section parallel to the rolling direction.

When the hardness ratio (Hv-ave$_p$)/(Hv-M) is between 0.8 and 0.9, the transverse tensile strength of steel plate (TS-T$_p$) falls in the range between 880 and 1080 MPa. Linepipes manufactured from this steel plate have a circumferential tensile strength (TS-C) of not lower than 900 MPa and, thus, a pressure carrying capacity required of X120 grade line pipes.

Steel plate whose transverse tensile strength thereof is not greater than 1080 MPa has excellent formability because the reaction force resulting from forming into tubular form is decreased.

The steel plate according to this invention, that consists primarily of degenerate upper bainite, has excellent impact properties.

Linepipes are required to have a property to stop fast ductile failure. In order to satisfy this requirement, the V-notch Charpy impact value of steel plate for linepipe at −20° C. must be not less than 200 J.

The steel of the present invention in which degenerate upper bainite accounts for more than approximately 70% and the ratio (Hv-ave$_p$)/(Hv-M) is between 0.8 and 0.9 has a V-notch Charpy impact value of not less than 200 J at −20° C.

In the steel of the present invention consisting primarily of degenerate upper bainite, the longitudinal tensile strength (TS-L$_p$) is smaller than the transverse tensile strength (TS-T$_p$), the former being held below 0.95 times the latter.

In conventional ultra-high-strength steel consisting primarily of lower bainite, by comparison, longitudinal tensile strength is substantially equal to the transverse tensile strength.

The linepipe manufactured by forming into a pipe form the steel plate of the present invention consisting primarily of degenerate upper bainite so that the rolling direction of the steel plate agrees with the longitudinal direction of the linepipe lowers the strength in the longitudinal direction while maintaining the strength in the circumferential direction unchanged.

This facilitates making the weld metal of field welds stronger than the longitudinal strength of linepipe and securing low-temperature toughness at field welds.

Although it is desirable to make the longitudinal tensile strength (TS-L$_p$) as small as possible compared to the transverse tensile strength (TS-T$_p$), it is, in reality, difficult to make the former less than 0.90 times the latter.

If yield ratio YS/TS, in which YS is 0.2% offset yield strength of steel plate and TS is tensile strength thereof, is low, formability in the process to form steel plate into a pipe form increases.

If yield ratio in the rolling direction of steel plate (YS-L$_p$)/(TS-L$_p$), in which (YS-L$_p$) is 0.2% offset yield strength in the rolling direction of steel plate and (TS-L$_p$) is tensile strength thereof, is low, yield ratio in the longitudinal direction of linepipe also becomes small.

Therefore, the base metal of a linepipe near the field welds of a pipeline becomes more deformable than the weld metal of the field welds.

When earthquake, crust movements, etc. cause deformation in the longitudinal direction of pipeline, the base metal of linepipe deforms and thereby inhibits the occurrence of the fracture of pipeline. To obtain this effect, it is preferable to keep the yield ratio in the rolling direction of steel plate (YS-L$_p$)/(TS-L$_p$) not greater than 0.80.

Next, a linepipe manufactured from the steel plate for ultra-high-strength linepipe consisting primarily of degenerate upper bainite according to the present invention will be described.

To secure the internal pressure resistance required of X120 grade line pipes, it is necessary to make the circumferential tensile strength thereof (TS-C) not less than 900 MPa.

If the circumferential tensile strength is greater than 1100 MPa, on the other hand, manufacture of linepipe becomes very difficult. Considering this difficulty in industrial control, it is preferable to set the upper limit of the circumferential tensile strength of linepipe at 1000 MPa.

As steel plate work-hardens under the influence of plastic strain when formed into line pipe, the hardness of linepipe Hv-ave becomes higher than that of steel plate. Work hardening sometimes increases the hardness Hv-ave of the ultra-high-strength linepipe according to this invention by approximately 20 from that of steel plate.

If the quantity of degenerate upper bainite in the microstructure of linepipe is quantified based on the hardness of martensite Hv-M that depends on carbon content, the quantity of degenerate upper bainite is underestimated because Hv-M does not take into account work hardening.

In the case of ultra-high-strength linepipe according to the present invention, therefore, the quantity of degenerate upper bainite may be quantified by deriving the hardness of the work-hardened lower bainite structure from the following equation "Hv-M*" that adds 20 to the hardness of martensite depending on carbon content and using the ratio Hv-ave/Hv-M*.

$$Hv\text{-}M^* = 290 + 1300C$$

While the acceptable range of Hv-ave/Hv-M* is 0.75 to 0.90, the preferable lower limit is 0.80.

The hardness of linepipe Hv-ave is the average of hardness measured by applying a load of 10 kgf at intervals of 1 mm across the thickness thereof in the longitudinal cross-section of linepipe.

The ultra-high-strength linepipe manufactured from the steel plate consisting primarily of degenerate upper bainite according to this invention also has excellent low-temperature toughness, just as with said steel plate. The V-notch Charpy impact value of the linepipe at −20° C. is 200 J or above.

The ultra-high-strength linepipe, according to the present invention, manufactured from the steel plate whose longitudinal tensile strength (TS-$L_p$) is not greater than 0.95 times the transverse tensile strength (TS-$T_p$) can have a longitudinal tensile strength (TS-L), like said steel plate, not greater than 0.95 times the circumferential tensile strength (TS-C) thereof.

Although it is desirable that TS-L is lower than TS-C as much as possible, it is, in reality, difficult to make TS-L not greater than 0.9 times TS-C.

Next, the reason why the constituent elements of the ultra-high-strength steel plate and linepipe according to the present invention are limited is explained below. The % used in the description means mass %.

C is limited to between 0.03 and 0.07%. As C is highly effective for increasing strength of steel, at least C of 0.03% is to bring the strength of steel plate and linepipe into the target range of this invention.

As, however, too much C significantly deteriorates the low-temperature toughness and field weldability of the base metal and heat-affected zone (HAZ), the upper limit is set at 0.07%. The preferable upper limit of C-content is 0.06%.

Si is added for deoxidation and enhancement of strength. As, however, excessive addition of Si significantly deteriorates the toughness of the HAZ and field weldability, the upper limit is set at 0.6%. As steel can be sufficiently deoxidized by addition of Al and Ti, addition of Si is not necessarily required.

Mn is an indispensable element for obtaining the microstructure of the steels according to this invention consisting primarily of degenerate upper bainite and balancing excellent strength with excellent low-temperature toughness. Addition of not less than 1.5% is necessary.

Too much addition of Mn, however, increases the hardenability of steel, thereby deteriorating the toughness of the HAZ and field weldability, and promotes center segregation in continuously cast slabs, thereby deteriorating the low-temperature toughness of the base metal. Therefore, the upper limit is set at 2.5%.

The contents of impurity elements P and S are respectively limited to not more than 0.015% and not more than 0.003%. This is primarily for further enhancing the low-temperature toughness of the base metal and HAZ.

Decreasing the P-content decreases center segregation in continuously cast slabs and enhances low-temperature toughness by preventing grain boundary fracture. Decreasing the S-content enhances ductility and toughness by decreasing MnS that is elongated by hot rolling.

The reason why Mo is added is to enhance the hardenability of steel and obtain the desired microstructure consisting primarily of degenerate upper bainite. Addition of Mo further enhances the hardenability enhancing effect of B addition.

Combined addition of Mo and Nb refines the austenite structure by inhibiting the recrystallization of austenite in controlled rolling. To ensure this effect, at least Mo of 0.15% is required to be added.

As, however, excessive addition of Mo deteriorates the toughness of the HAZ and field weldability and impairs the hardenability enhancing effect of B, the upper limit of addition is set at 0.60%.

Combined addition of Nb with Mo not only refines and stabilizes degenerate upper bainite structure by inhibiting the recrystallization of austenite in controlled rolling but also strengthens steel by contributing to precipitation hardening and enhancement of hardenability.

Combined addition of Nb with B synergistically enhances the hardenability increasing effect. Adding Nb of 0.01% or more prevents excessive softening of the heat-affected zone. As, however, too much addition of Nb has an adverse effect on the toughness of the HAZ and field weldability, the upper limit of addition is set at 0.10%.

Ti fixes solid solution of N deleterious to the hardenability enhancing effect of B and is valuable as a deoxidizing element. When the Al-content is as low as not more than 0.005%, in particular, Ti forms oxide, serves as the transgranular ferrite production nucleus, and refines the structure of the HAZ. To insure these effects, Ti addition must be not less than 0.005%.

Fine precipitation of TiN inhibits the coarsening of austenite grains during slab reheating and in the HAZ and refines microstructure, thereby enhancing the low-temperature toughness of the base metal and HAZ. To insure this effect, it is preferable to add a quantity of Ti greater than 3.4N (mass %).

As, however, too much Ti addition deteriorates low-temperature toughness by precipitation hardening of TiC and coarsening of TiN, the upper limit is set at 0.030%.

Al that is usually contained in steel as a deoxidizer also has a microstructure refining effect. As, however, Al-based nonmetallic inclusions increase and impair the cleanliness of steel if Al addition exceeds 0.10%, the upper limit is set at 0.10%.

The preferable upper limit of Al addition is 0.06%. If sufficient deoxidation is done by adding Ti and Si, there is no need to add Al.

The object of adding Ni is to enhance the low-temperature toughness, strength and other properties of the low-carbon steels according to this invention without deteriorating the field weldability thereof.

Addition of Ni is less likely, than that of Mn, Cr and Mo, to form a hardened structure deleterious to low-temperature toughness in the rolled structure and, in particular, in the center segregation zone of continuously cast slabs. It was discovered that addition of Ni of not less than 0.1% is effective in enhancing the toughness of the HAZ.

The particularly effective quantity of Ni addition for the enhancement of the HAZ toughness is not less than 0.3%. As, however, excessive addition of Ni not only impairs cost effectiveness but also deteriorates the HAZ toughness and field weldability, the upper limit is set at 1.5%.

Ni addition is also effective for the prevention of copper-cracking during continuous casting and hot-rolling. It is preferable that the quantity of Ni added is not less than one-third that of Cu.

The object of adding one or more of B, N, V, Cu, Cr, Ca, REM (rare-earth metals) and Mg will be described below. The primary object of adding one or more of said elements in addition to the basic constituents is to further enhance strength and toughness and expand the range of manufacturable sizes without impairing the excellent features of the steels according to the present invention.

B is a highly effective element in obtaining a microstructure consisting primarily of degenerate upper bainite because small addition thereof dramatically enhances the hardenability of steel.

Furthermore, B heightens the hardenability enhancing effect of Mo and synergistically increases hardenability when present with Nb. As, however, excessive addition of B not only deteriorates low-temperature toughness but also destroys the hardenability enhancing effect of B, the upper limit of addition is set at 0.0025%.

N inhibits coarsening of austenite grains during slab reheating and in the HAZ by forming TiN and enhances the low-temperature toughness of the base metal and HAZ. To obtain this effect, it is desirable to add N to not less than 0.001%.

As, however, too much N impairs the hardenability enhancing effect of B addition by producing slab surface defects and deteriorating the toughness of the HAZ by forming soluble-N, it is preferable to set the upper limit of N addition at 0.006%.

V has a substantially similar, but not as strong, effect as Nb. Still, addition of V to ultra-high-strength steel is effective and combined addition of Nb and V further enhances the excellent features of the steels according to the present invention. While the acceptable upper limit is 0.10% from the viewpoint of the toughness of the HAZ and field weldability, the particularly preferable range is between 0.03 and 0.08%.

Cu and Cr increases the strength of the base metal and HAZ but significantly deteriorates the toughness of the HAZ and field weldability when added in excess. Therefore, it is preferable to set the upper limit of Cu and Cr addition to at 1.0% each.

Ca and REM enhance low-temperature toughness by controlling the shape of sulfides, in particular MnS. However, addition of Ca of over 0.01% or REM of over 0.02% produces large quantities of CaO—CaS or REM-CaS that form large clusters and inclusions that, in turn, not only destroy the cleanliness of steel but also have adverse effect on field weldability.

Therefore, the upper limit of Ca addition is set at 0.01% or preferably 0.006% and that of REM at 0.02%.

Also, it is particularly effective for ultra-high-strength line pipe to keep S and O contents below 0.001% and 0.002%, respectively, and the value of ESSP=(Ca) [1-124(O)]/1.25S in the range $0.5 \leqq ESSP \leqq 10.0$.

Mg forms fine dispersed oxides and enhances low-temperature toughness by inhibiting the grain coarsening in the HAZ. Addition of Mg in excess of 0.006% forms coarse oxides and deteriorates toughness.

In addition to the above limitations to the addition of individual elements, it is necessary to keep the P value, which is an index of hardenability, in the range $2.5 \leqq P \leqq 4.0$. This is necessary for securing the balance between strength and low-temperature toughness targeted by the ultra-high-strength steel plate and linepipe according to this invention.

The reason why the lower limit of the P value is set at 2.5 is to obtain excellent low-temperature toughness by keeping the circumferential tensile strength of linepipe at 900 MPa or above. The reason why the upper limit of the P value is set at 4.0 is to maintain excellent HAZ toughness and field weldability.

The P value can be derived from the following equation that involves the quantities of individual elements added (in mass %):

$$P=2.7C+0.4Si+Mn+0.8Cr+0.45(Ni+Cu)+\frac{(1+\beta)Mo}{1+\beta}-1$$

Where $\beta=1$ when $B \geqq 3$ ppm and $\beta=1$ when $B<3$ ppm.

If B of less than 3 ppm is added, the P value is derived from the following equation:

$$P=2.7C+0.4Si+Mn+0.8Cr+0.45(Ni+Cu)+Mo-1$$

If B of not less than 3 ppm is added, the P value is derived from the following equation:

$$P=2.7C+0.4Si+Mn+0.8Cr+0.45(Ni+Cu)+2Mo$$

In order to manufacture steel plate having a microstructure consisting primarily of fine degenerate upper bainite, it is necessary to keep not only composition of steel but also manufacturing conditions within appropriate ranges.

First, continuously cast slab is hot-worked in the recrystallizing temperature zone and the recrystallized grains are transformed to austenite grains flattened in the direction of thickness by rolling in the unrecrystallization region. Rolling in the unrecrystallization region is hot-rolling performed in the unrecrystallization and austenite temperature range that is below the recrystallizing temperature and above the temperature at which ferrite transformation begins when cooled that is in the unrecrystallization temperature region.

Next, the obtained steel plate is cooled from the austenite region at an appropriate cooling rate that is above the rate at which coarse granular bainite is formed and below the rate at which lower bainite and martensite are formed.

The slab manufactured by continuous casting or primary rolling is heated to between 1000° C. and 1250° C. If the temperature is below 1000° C., added elements do not form adequate solid solutions and cast structures are not sufficiently refined. If the temperature is over 1250° C., crystal grains are coarsened.

The heated slab is subjected to rough rolling in the recrystallizing temperature zone that is not higher than the heating temperature and over 900° C. The object of this rough rolling is to make crystal grains as fine as possible before the subsequent rolling in the unrecrystallization region.

Following the rough rolling, rolling in the unrecrystallization region with a cumulative rolling reduction of not less than 75% is carried out in the unrecrystallization temperature region not higher than 900° C. and the austenite region not lower than 700° C. As the steels according to this invention contain much Nb and other alloy elements, temperatures not higher than 900° C. are in the unrecrystallization region. The rolling in the unrecrystallization region should be finished at 700° C. or above in the austenite region.

To make the transverse tensile strength of steel plate TS-$T_p$ greater than the longitudinal tensile strength TS-$L_p$ to ultimately make the circumferential tensile strength of linepipe TS-C greater than the longitudinal tensile strength thereof TS-L, it is necessary to increase the percentage of elongation of crystal grains in the rolling direction.

To make TS-$L_p$ of the steel plate not greater than 0.95 times TS-$T_p$ and TS-L of the linepipe not greater than 0.95 times TS-C, it is preferable to make the cumulative rolling reduction greater than 80%.

Then, steel plate is cooled from the austenite region at 700° C. or above to 500° C. or below at a cooling rate of 1 to 10° C./sec. in the center of the thickness thereof.

If the cooling rate in the center of the thickness of the steel plate exceeds 10° C./sec., the surface region of the steel plate becomes lower bainite. If the cooling rate becomes 20° C./sec. or above, the entire cross section thereof becomes lower bainite.

If the cooling rate is lower than 1° C./sec., the steel plate becomes granular bainite and loses toughness. If the cooling rate is too fast or too slow, TS-$L_p$ of the steel plate does not become lower than 0.95 times TS-$T_p$ and TS-L of the linepipe does not become lower than 0.95 times TS-C.

It is considered that the cause of the difference between TS-$L_p$ and TS-$T_p$ of the steel plate and the difference between TS-L and TS-C of the linepipe lies mainly in rolling in the unrecrystallization region. Therefore, it is difficult to make TS-$L_p$ of the steel plate under 0.90 times TS-$T_p$ and TS-L of the linepipe under 0.90 times TS-C.

It is furthermore necessary to make the lower limit of the temperature range in which cooling rate is controlled not higher than 500° C. where the transformation from austenite to degenerate upper bainite ends, or preferably between 300° C. and 450° C.

Steel pipe is made by forming the steel plate obtained as described above into a pipe form so that the rolling direction agrees with the longitudinal direction of the pipe and then welding together the edges thereof.

The linepipes according to the present invention are generally 450 to 1500 mm in diameter and 10 to 40 mm in wall thickness. An established method to efficiently manufacture steel pipes in the size ranges described above comprises a UO process in which the steel plate is first formed into U-shape and then into O-shape, tack welding the edges, submerged-arc welding them from both inside and outside, and then expansion to increase the degree of roundness.

To increase the degree of roundness by expanding, the linepipe must be deformed into the plastic region. In the case of the high-strength linepipe according to the present invention, the expansion rate is preferably not less than approximately 0.7%.

The expansion rate is defined as Expansion rate=(Circumference after expansion−Circumference before expansion)/Circumference before expansion).

If the expansion rate is made greater than 2%, toughness of the base metal and weld deteriorates greatly as a result of plastic deformation. Therefore, it is preferable to keep the expansion rate between 0.7% and 2.0%.

EXAMPLE

Steel plates were manufactured by preparing steels having chemical compositions shown in Table 1 by using a 300 ton basic oxygen furnace, continuously casting the steels into slabs, reheating the slabs to 1100° C., rolling in the recrystallization region, reducing the thickness to 18 mm by applying controlled-rolling with a cumulative rolling reduction of 80% between 900° C. and 750° C., and applying water cooling at a rate of 1 to 10° C./sec. in the center of the thickness of the plate so that cooling ends between 300° C. and 500° C.

The steel plates were formed into a pipe form in the UO process and the edges were tack welded and, then, submerged-arc welded. The welded pipes were expanded by 1% into pipes having an outside diameter of 965 mm. Submerged-arc welding was applied one pass each from both inside and outside, with three electrodes, at a speed of 1.5 m/min. and with a heat input of 2.8 kJ/mm.

Test specimens were taken from the steel plates and pipes thus manufactured and subjected to tensile and Charpy impact tests. Tensile tests were conducted pursuant to API 5L. Full-thickness specimens were taken parallel to the length and width of the steel plates and the length of the steel pipes and subjected to tensile tests.

For tensile tests in the circumferential direction, full-thickness arc-shaped strips were taken and flattened by press-working and made into full-thickness strip specimens. The specimens were subjected to tensile tests in which yield strength was determined in terms of 0.2% offset yield strength.

Charpy impact tests were conducted at −30° C. by using full-size 2 mm V-notch test specimens whose length agrees with the width of the steel plates and the circumference of the steel pipes. If the Charpy impact value is not smaller than 200 J at −30° C., Charpy impact values of 200 J or above are obtainable at −20° C.

Table 2 shows the manufacturing conditions and properties of the steel plates and Table 3 shows the properties of the steel pipes.

The steel plates and pipes of Examples Nos. 1 to 8 manufactured by using steels A to E of the chemical compositions under the conditions, both of which are within the ranges specified by the present invention, have strengths within the target range and high low-temperature toughnesses.

Though the steel plate and pipe of Example No. 9 tested for comparison were made of steel D whose chemical composition is within the range of the present invention but with a cooling rate faster than the range of the present invention, Hv-ave/Hv-M and Hv-ave/Hv-M* are outside the range of the present invention. Though the steel plate and pipe of Example No. 10 tested for comparison were made of steel C whose chemical composition is within the range of the present invention but with a cooling rate slower than the range of the present invention, TS-$T_p$ and TS-C are outside the range of the present invention.

Example No. 11 was tested for comparison, which was made of steel G with a high carbon content and without nickel addition, has a low low-temperature toughness.

TABLE 1

| Steel | C | Si | Mn | P | S | Ni | Mo | Nb | Ti | Al | N | B | V | Cu | Cr | Others | P value | Remarks |
|---|---|---|---|---|---|---|---|---|---|---|---|---|---|---|---|---|---|---|
| A | 0.058 | 0.09 | 1.95 | 0.012 | 0.001 | 0.36 | 0.35 | 0.021 | 0.012 | 0.024 | 0.0027 | 0.0014 | | | 0.28 | | 3.2 | Examples |
| B | 0.052 | 0.25 | 1.65 | 0.007 | 0.001 | 1.20 | 0.47 | 0.028 | 0.015 | 0.003 | 0.0036 | | | 0.79 | 0.81 | Ca: 0.004 | 2.9 | of the present |

TABLE 1-continued

| Steel | C | Si | Mn | P | S | Ni | Mo | Nb | Ti | Al | N | B | V | Cu | Cr | Others | P value | Remarks |
|---|---|---|---|---|---|---|---|---|---|---|---|---|---|---|---|---|---|---|
| C | 0.036 | 0.11 | 1.78 | 0.005 | 0.001 | 0.85 | 0.45 | 0.012 | 0.014 | 0.033 | 0.0024 | 0.0009 | 0.063 | | | | 3.2 | invention |
| D | 0.046 | 0.28 | 2.03 | 0.008 | 0.002 | 0.37 | 0.52 | 0.033 | 0.018 | 0.018 | 0.0041 | | 0.052 | 0.40 | 0.65 | Mg: 0.0008 | 2.7 | |
| E | 0.055 | 0.06 | 2.41 | 0.011 | 0.001 | | 0.55 | 0.018 | 0.015 | 0.037 | 0.0039 | | | | 0.78 | | 2.8 | |
| F | 0.049 | 0.15 | 2.28 | 0.006 | 0.001 | | 0.38 | 0.015 | 0.016 | 0.022 | 0.0038 | 0.0011 | | | | | 3.2 | |
| G | 0.10 | 0.47 | 2.00 | 0.011 | 0.001 | | 0.14 | 0.036 | 0.017 | 0.026 | 0.0030 | 0.0013 | | | | | 2.7 | Examples for comparison |

The blanks in the table indicate that values are below the detectable limit.
The underlined values in the table are outside the range according to the present invention.

15

The blanks in the table indicate that values are below the detectable limit.

The underlined values in the table are outside the range according to the present invention.

TABLE 2

| Example No. | Steel | Cooling Rate ° C./sec. | Cooling Stopping Temperature ° C. | Properties of Steel Plates: Hv-ave | Hv-ave/Hv-M | Microstructure | TS-$L_p$ MPa | TS-$T_p$ MPa | YS-$L_p$ MPa | TS-$L_p$/TS-$L_p$ | TS-$L_p$/TS-$T_p$ | $vE_{-30}$ J | Remarks |
|---|---|---|---|---|---|---|---|---|---|---|---|---|---|
| 1 | A | 8 | 370 | 304 | 0.88 | Degenerate upper bainite | 941 | 991 | 743 | 0.79 | 0.95 | 241 | Examples of the present invention |
| 2 | A | 2 | 410 | 279 | 0.81 | Degenerate upper bainite | 864 | 919 | 665 | 0.77 | 0.94 | 212 | |
| 3 | B | 5 | 380 | 291 | 0.86 | Degenerate upper bainite | 900 | 957 | 702 | 0.78 | 0.94 | 263 | |
| 4 | C | 5 | 310 | 282 | 0.89 | Degenerate upper bainite | 872 | 938 | 663 | 0.76 | 0.93 | 290 | |
| 5 | C | 5 | 450 | 273 | 0.86 | Degenerate upper bainite | 845 | 889 | 625 | 0.74 | 0.95 | 278 | |
| 6 | D | 5 | 400 | 270 | 0.82 | Degenerate upper bainite | 839 | 902 | 629 | 0.75 | 0.93 | 275 | |
| 7 | E | 8 | 360 | 301 | 0.88 | Degenerate upper bainite | 953 | 993 | 762 | 0.80 | 0.96 | 212 | |
| 8 | F | 5 | 390 | 275 | 0.82 | Degenerate upper bainite | 834 | 901 | 634 | 0.76 | 0.93 | 222 | |
| 9 | D | 30 | 390 | 330 | 1.00 | Lower bainite | 1018 | 1060 | 865 | 0.85 | 0.96 | 276 | Examples for comparison |
| 10 | C | 0.5 | 350 | 242 | 0.76 | Granular bainite | 756 | 822 | 552 | 0.73 | 0.92 | 114 | |
| 11 | G | 5 | 370 | 299 | 0.75 | Degenerate upper bainite | 949 | 997 | 740 | 0.78 | 0.95 | 129 | |

The underlined values in the table are outside the range according to the present invention.

The underlined values in the table are outside the range according to the present invention.

TABLE 3

| Example No. | Steel | Properties of Steel Plates: Hv-ave | Hv-ave/Hv-M | Hv-ave/Hv-M* | Microstructure | TS-L MPa | TS-C MPa | YS-L MPa | TS-L/TS-C | $vE_{-30}$ J | Remarks |
|---|---|---|---|---|---|---|---|---|---|---|---|
| 1 | A | 322 | 0.93 | 0.88 | Degenerate upper bainite | 961 | 1012 | 912 | 0.95 | 237 | Examples of the present invention |
| 2 | A | 300 | 0.87 | 0.82 | Degenerate upper bainite | 868 | 943 | 812 | 0.92 | 205 | |
| 3 | B | 304 | 0.9 | 0.85 | Degenerate upper bainite | 924 | 983 | 878 | 0.94 | 255 | |
| 4 | C | 293 | 0.92 | 0.87 | Degenerate upper bainite | 897 | 964 | 842 | 0.93 | 271 | |
| 5 | C | 294 | 0.95 | 0.87 | Degenerate upper bainite | 838 | 921 | 786 | 0.91 | 274 | |
| 6 | D | 287 | 0.87 | 0.82 | Degenerate upper bainite | 862 | 927 | 810 | 0.93 | 269 | |

TABLE 3-continued

| Example No. | Steel | Hv-ave | Hv-ave/ Hv-M | Hv-ave/ Hv-M* | Microstructure | TS-L MPa | TS-C MPa | YS-L MPa | TS-L/ TS-C | $vE_{-30}$ J | Remarks |
|---|---|---|---|---|---|---|---|---|---|---|---|
| | | Properties of Steel Plates | | | | | | | | | |
| 7 | E | 322 | 0.94 | 0.89 | Degenerate upper bainite | 977 | 1018 | 890 | 0.96 | 192 | |
| 8 | F | 287 | 0.86 | 0.81 | Degenerate upper bainite | 866 | 931 | 805 | 0.93 | 228 | |
| 9 | D | 390 | 1.18 | 0.99 | Lower bainite | 1062 | 1095 | 1030 | 0.97 | 275 | Examples of |
| 10 | C | 253 | 0.79 | 0.75 | Granular bainite | 764 | 840 | 711 | 0.91 | 106 | comparison |
| 11 | G | 312 | 0.78 | 0.74 | Degenerate upper bainite | 964 | 1026 | 915 | 0.94 | 121 | |

The underlined values in the table are outside the range according to the present invention.

The underlined values in the table are outside the range according to the present invention.

INDUSTRIAL APPLICABILITY

This invention provides ultra-high-strength linepipes providing excellent low-temperature toughness in field welds and excellent longitudinal resistance applicable for pipelines in discontinuous tundras and other regions, where the ground moves with the season, and methods of manufacturing such linepipes. Therefore, this invention has significantly marked industrial contributions.

The invention claimed is:

1. Steel plate for ultra-high-strength linepipe having excellent low-temperature toughness consisting essentially of:

| | |
|---|---|
| C | 0.03 to 0.07 mass % |
| Si | not more than 0.28 mass % |
| Mn | 1.5 to 2.5 mass % |
| P | not more than 0.015 mass % |
| S | not more than 0.003 mass % |
| Mo | 0.15 to 0.60 mass % |
| Nb | 0.01 to 0.10 mass % |
| Ti | 0.005 to 0.030 mass % |
| Al | not more than 0.10 mass % |
| and, one or more of: | |
| Ni | 0.1 to 1.5 mass % |
| B | less than 3 ppm |
| V | not more than 0.10 mass % |
| Cu | not more than 1.0 mass % |
| Cr | not more than 1.0 mass % |
| Ca | not more than 0.01 mass % |
| REM | not more than 0.02 mass % |
| Mg | not more than 0.006 mass % |

and the remainder being iron and unavoidable impurities and having the value P defined below being between 2.5 and 4.0, and having a microstructure composed of degenerate upper bainite of more than 70%, in which;

the ratio (Hv-avep)/(Hv-M) between the average Vickers hardness Hv-avep in the direction of thickness and the martensitic hardness Hv-M determined by carbon content is between 0.8 and 0.9, and the transverse tensile strength TS-Tp is between 880 MPa and 1080 MPa, $$P=2.7C+0.4Si+Mn+0.8Cr+0.45(Ni+Cu)+Mo-1$$

$$Hv\text{-}M=270+1300C$$

wherein the symbols of elements designate the mass % of the individual elements.

2. Steel plate for ultra-high-strength linepipe having excellent low-temperature toughness consisting essentially of:

| | |
|---|---|
| C | 0.03 to 0.07 mass % |
| Si | not more than 0.28 mass % |
| Mn | 1.5 to 2.5 mass % |
| P | not more than 0.015 mass % |
| S | not more than 0.003 mass % |
| Mo | 0.15 to 0.60 mass % |
| Nb | 0.01 to 0.10 mass % |
| Ti | 0.005 to 0.030 mass % |
| Al | not more than 0.10 mass % |
| B | 3 ppm to 0.0025 mass % |
| and, one or more of: | |
| Ni | 0.1 to 1.5 mass % |
| N | 0.001 to 0.006 mass % |
| V | not more than 0.10 mass % |
| Cu | not more than 1.0 mass % |
| Cr | not more than 1.0 mass % |
| Ca | not more than 0.01 mass % |
| REM | not more than 0.02 mass % |
| Mg | not more than 0.006 mass % |

and the remainder being iron and unavoidable impurities and having the value P defined below being between 2.5 and 4.0, and having a microstructure composed of degenerate upper bainite of more than 70%, in which;

the ratio (Hv-avep)/(Hv-M) between the average Vickers hardness Hv-avep in the direction of thickness and the martensitic hardness Hv-M determined by carbon content is between 0.8 and 0.9, and the transverse tensile strength TS-Tp is between 880 MPa and 1080 MPa, $$P=2.7C+0.4Si+Mn+0.8Cr+0.45(Ni+Cu)+2Mo$$

$$Hv\text{-}M=270+1300C$$

wherein the symbols of elements designate the mass % of the individual elements.

3. Steel plate for ultra-high-strength linepipe having excellent low-temperature toughness consisting essentially of:

| | |
|---|---|
| C | 0.03 to 0.07 mass % |
| Si | not more than 0.28 mass % |
| Mn | 1.5 to 2.5 mass % |
| P | not more than 0.015 mass % |
| S | not more than 0.003 mass % |
| Mo | 0.15 to 0.60 mass % |
| Nb | 0.01 to 0.10 mass % |
| Ti | 0.005 to 0.030 mass % |
| Al | not more than 0.10 mass % |
| and, one or more of: | |
| Ni | 0.1 to 1.5 mass % |
| B | less than 3 ppm |
| V | not more than 0.10 mass % |

-continued

| | |
|---|---|
| Cu | not more than 1.0 mass % |
| Cr | not more than 1.0 mass % |
| Ca | not more than 0.01 mass % |
| REM | not more than 0.02 mass % |
| Mg | not more than 0.006 mass % |

and the remainder being iron and unavoidable impurities and having the value P defined below being between 2.5 and 4.0, and having a microstructure composed of degenerate upper bainite of more than 70%, in which;

the ratio (Hv-avep)/(Hv-M) between the average Vickers hardness Hv-avep in the direction of thickness and the martensitic hardness Hv-M determined by carbon content is between 0.8 and 0.9, and the transverse tensile strength TS-Tp is between 880 MPa and 1080 MPa, $$P=2.7C+0.4Si+Mn+0.8Cr+0.45(Ni+Cu)+Mo-1$$

$$Hv\text{-}M=270+1300C$$

wherein the symbols of elements designate the mass % of the individual elements.

4. Steel plate for ultra-high-strength linepipe having excellent low-temperature toughness described in claim 3, in which the relationship Ti−3.4 N>0 is satisfied (wherein the symbols of elements designate the mass % of the individual elements).

5. Steel plate for ultra-high-strength linepipe having excellent low-temperature toughness described in claim 1, in which the V-notch Charpy value at −20° C. is not lower than 200 J.

6. Steel plate for ultra-high-strength linepipe having excellent low-temperature toughness described in claim 1, in which the longitudinal tensile strength TS-Lp is not greater than 0.95 times the transverse tensile strength TS-Tp.

7. Steel plate for ultra-high-strength linepipe having excellent low-temperature toughness described in claim 1, in which the yield ratio in the direction of rolling (YS-Lp)/(TS-Lp), which is the ratio of the 0.2% offset yield strength YS-Lp in the direction of rolling to the tensile strength TS-Lp in the direction of rolling is not greater than 0.8.

8. Ultra-high-strength linepipe having excellent low-temperature toughness prepared by seam-welding steel plate consisting essentially of:

| | |
|---|---|
| C | 0.03 to 0.07 mass % |
| Si | not more than 0.28 mass % |
| Mn | 1.5 to 2.5 mass % |
| P | not more than 0.015 mass % |
| S | not more than 0.003 mass % |
| Ni | 0.1 to 1.5 mass % |
| Mo | 0.15 to 0.60 mass % |
| Nb | 0.01 to 0.10 mass % |
| Ti | 0.005 to 0.030 mass % |
| Al | not more than 0.06 mass % |
| and, one or more of: | |
| B | not more than 0.0025 mass % |
| N | 0.001 to 0.006 mass % |
| V | not more than 0.10 mass % |
| Cu | not more than 1.0 mass % |
| Cr | not more than 1.0 mass % |
| Ca | not more than 0.01 mass % |
| REM | not more than 0.02 mass % |
| Mg | not more than 0.006 mass % |

and the remainder being iron and unavoidable impurities and having the value P defined below being between 2.5 and 4.0, and having a microstructure composed of degenerate upper bainite of more than 70%, in which;

the ratio (Hv-ave)/(Hv-M) between the average Vickers hardness Hv-ave in the direction of thickness of the base metal and the martensitic hardness Hv-M determined by carbon content is between 0.8 and 0.9 and the circumferential tensile strength TS-C is between 900 MPa and 1100 MPa, $$P=2.7C+0.4Si+Mn+0.8Cr+0.45(Ni+Cu)+(1+\beta)Mo-1+\beta$$

where $\beta=1$ when $B\geqq 3$ ppm and $\beta=0$ when $B<3$ ppm $$Hv\text{-}M=270+1300C$$

wherein the symbols of elements designate the mass % of the individual elements.

9. Ultra-high-strength linepipe having excellent low-temperature toughness prepared by seam-welding steel plate consisting essentially of:

| | |
|---|---|
| C | 0.03 to 0.07 mass % |
| Si | not more than 0.28 mass % |
| Mn | 1.5 to 2.5 mass % |
| P | not more than 0.015 mass % |
| S | not more than 0.003 mass % |
| Mo | 0.15 to 0.60 mass % |
| Nb | 0.01 to 0.10 mass % |
| Ti | 0.005 to 0.030 mass % |
| Al | not more than 0.10 mass % |
| and, one or more of: | |
| Ni | 0.1 to 1.5 mass % |
| B | less than 3 ppm |
| V | not more than 0.10 mass % |
| Cu | not more than 1.0 mass % |
| Cr | not more than 1.0 mass % |
| Ca | not more than 0.01 mass % |
| REM | not more than 0.02 mass % |
| Mg | not more than 0.006 mass % |

and the remainder being iron and unavoidable impurities and having the value P defined below being between 2.5 and 4.0, and having a microstructure composed of degenerate upper bainite of more than 70%, in which;

the ratio (Hv-ave)/(Hv-M*) between the average Vickers hardness Hv-ave in the direction of thickness of the base metal and the martensitic hardness Hv-M* determined by carbon content is between 0.75 and 0.9 and the circumferential tensile strength TS-C is between 900 MPa and 1100 MPa, $$P=2.7C+0.4Si+Mn+0.8Cr+0.45(Ni+Cu)+Mo-1$$

$$Hv\text{-}M^*=290+1300C$$

wherein the symbols of elements designate the mass % of the individual elements.

10. Ultra-high-strength linepipe having excellent low-temperature toughness prepared by seam-welding steel plate consisting essentially of:

| | |
|---|---|
| C | 0.03 to 0.07 mass % |
| Si | not more than 0.28 mass % |
| Mn | 1.5 to 2.5 mass % |
| P | not more than 0.015 mass % |
| S | not more than 0.003 mass % |
| Mo | 0.15 to 0.60 mass % |
| Nb | 0.01 to 0.10 mass % |
| Ti | 0.005 to 0.030 mass % |
| Al | not more than 0.10 mass % |

-continued

| | |
|---|---|
| B | 3 ppm to 0.0025 mass % |
| and, one or more of: | |
| Ni | 0.1 to 1.5 mass % |
| N | 0.001 to 0.006 mass % |
| V | not more than 0.10 mass % |
| Cu | not more than 1.0 mass % |
| Cr | not more than 1.0 mass % |
| Ca | not more than 0.01 mass % |
| REM | not more than 0.02 mass % |
| Mg | not more than 0.006 mass % |

and the remainder being iron and unavoidable impurities and having the value P defined below being between 2.5 and 4.0, and having a microstructure composed of degenerate upper bainite of more than 70%, in which;

the ratio (Hv-ave)/(Hv-M*) between the average Vickers hardness Hv-ave in the direction of thickness of the base metal and the martensitic hardness Hv-M* determined by carbon content is between 0.75 and 0.9 and the circumferential tensile strength TS-C is between 900 MPa and 1100 MPa, $$P=2.7C+0.4Si+Mn+0.8Cr+0.45(Ni+Cu)+2Mo$$

$$Hv\text{-}M^*=290+1300C$$

wherein the symbols of elements designate the mass % of the individual elements.

11. Ultra-high-strength linepipe having excellent low-temperature toughness prepared by seam-welding steel plate consisting essentially of:

| | |
|---|---|
| C | 0.03 to 0.07 mass % |
| Si | not more than 0.28 mass % |
| Mn | 1.5 to 2.5 mass % |
| P | not more than 0.015 mass % |
| S | not more than 0.003 mass % |
| Mo | 0.15 to 0.60 mass % |
| Nb | 0.01 to 0.10 mass % |
| Ti | 0.005 to 0.030 mass % |
| Al | not more than 0.10 mass % |
| and, one or more of: | |
| Ni | 0.1 to 1.5 mass % |
| B | less than 3 ppm |
| V | not more than 0.10 mass % |
| Cu | not more than 1.0 mass % |
| Cr | not more than 1.0 mass % |
| Ca | not more than 0.01 mass % |
| REM | not more than 0.02 mass % |
| Mg | not more than 0.006 mass % |

and the remainder being iron and unavoidable impurities and having the value P defined below being between 2.5 and 4.0, and having a microstructure composed of degenerate upper bainite of more than 70%, in which;

the ratio (Hv-ave)/(Hv-M*) between the average Vickers hardness Hv-ave in the direction of thickness of the base metal and the martensitic hardness Hv-M* determined by carbon content is between 0.75 and 0.9 and the circumferential tensile strength TS-C is between 900 MPa and 1100 MPa, $$P=2.7C+0.4Si+Mn+0.8Cr+0.45(Ni+Cu)+Mo-1$$

$$Hv\text{-}M^*=290+1300C$$

wherein the symbols of elements designate the mass % of the individual elements.

12. Ultra-high-strength linepipe having excellent low-temperature toughness described in claim 11, in which the relationship Ti−3.4 N>0 is satisfied (wherein the symbols of elements designate the mass % of the individual elements).

13. Ultra-high-strength linepipe having excellent low-temperature toughness described in claim 8, in which the V-notch Charpy value at −20° C. is not lower than 200 J.

14. Ultra-high-strength linepipe having excellent low-temperature toughness described in claim 8, in which the tensile strength in the longitudinal direction of linepipe is not greater than 0.95 times the tensile strength in the circumferential direction thereof.

15. A method for manufacturing steel plate for ultra-high-strength linepipe having excellent low-temperature toughness comprising the steps of:

heating slabs consisting essentially of:

| | |
|---|---|
| C | 0.03 to 0.07 mass % |
| Si | not more than 0.28 mass % |
| Mn | 1.5 to 2.5 mass % |
| P | not more than 0.015 mass % |
| S | not more than 0.003 mass % |
| Mo | 0.15 to 0.60 mass % |
| Nb | 0.01 to 0.10 mass % |
| Ti | 0.005 to 0.030 mass % |
| Al | not more than 0.10 mass % |
| and, one or more of: | |
| Ni | 0.1 to 1.5 mass % |
| B | less than 3 ppm |
| V | not more than 0.10 mass % |
| Cu | not more than 1.0 mass % |
| Cr | not more than 1.0 mass % |
| Ca | not more than 0.01 mass % |
| REM | not more than 0.02 mass % |
| Mg | not more than 0.006 mass % |

and the remainder being iron and unavoidable impurities and having the value P defined below being between 2.5 and 4.0 and between 1000 and 1250° C., and having a microstructure composed of degenerate upper bainite of more than 70%, rough rolling in a recrystallizing region, rolling in an unrecrystallization austenitic region at 900° C. or below with a cumulative rolling reduction of not less than 75% and, then, applying accelerated cooling from the austenitic region so that the center of plate thickness cools to 500° C. or below at a rate of 1 to 10° C./sec., $$P=2.7C+0.4Si+Mn+0.8Cr+0.45(Ni+Cu)+Mo-1$$

wherein the symbols of elements designate the mass % of the individual elements.

16. A method for manufacturing steel plate for ultra-high-strength linepipe having excellent low-temperature toughness comprising the steps of:

heating slabs consisting essentially of:

| | |
|---|---|
| C | 0.03 to 0.07 mass % |
| Si | not more than 0.28 mass % |
| Mn | 1.5 to 2.5 mass % |
| P | not more than 0.015 mass % |
| S | not more than 0.003 mass % |
| Mo | 0.15 to 0.60 mass % |
| Nb | 0.01 to 0.10 mass % |
| Ti | 0.005 to 0.030 mass % |
| Al | not more than 0.10 mass % |
| B | 3 ppm to 0.0025 mass % |

-continued

| | |
|---|---|
| and, one or more of: | |
| Ni | 0.1 to 1.5 mass % |
| N | 0.001 to 0.006 mass % |
| V | not more than 0.10 mass % |
| Cu | not more than 1.0 mass % |
| Cr | not more than 1.0 mass % |
| Ca | not more than 0.01 mass % |
| REM | not more than 0.02 mass % |
| Mg | not more than 0.006 mass % |

and the remainder being iron and unavoidable impurities and having the value P defined below being between 2.5 and 4.0 and between 1000 and 1250° C., and having a microstructure composed of degenerate upper bainite of more than 70%, rough rolling in a recrystallized region, rolling in an unrecrystallization austenitic region at 900° C. or below with a cumulative rolling reduction of not less than 75% and, then, applying accelerated cooling from the austenitic region so that the center of plate thickness cools to 500° C. or below at a rate of 1 to 10° C./sec., $$P=2.7C+0.4Si+Mn+0.8Cr+0.45(Ni+Cu)+2Mo$$

wherein the symbols of elements designate the mass % of the individual elements.

17. A method for manufacturing steel plate for ultra-high-strength linepipe having excellent low-temperature toughness comprising the steps of:

heating slabs consisting essentially of:

| | |
|---|---|
| C | 0.03 to 0.07 mass % |
| Si | not more than 0.28 mass % |
| Mn | 1.5 to 2.5 mass % |
| P | not more than 0.015 mass % |
| S | not more than 0.003 mass % |
| Mo | 0.15 to 0.60 mass % |
| Nb | 0.01 to 0.10 mass % |
| Ti | 0.005 to 0.030 mass % |
| Al | not more than 0.10 mass % |
| and, one or more of: | |
| Ni | 0.1 to 1.5 mass % |
| B | less than 3 ppm |
| V | not more than 0.10 mass % |
| Cu | not more than 1.0 mass % |
| Cr | not more than 1.0 mass % |
| Ca | not more than 0.01 mass % |
| REM | not more than 0.02 mass % |
| Mg | not more than 0.006 mass % |

and the remainder being iron and unavoidable impurities and having the value P defined below being between 2.5 and 4.0 and between 1000 and 1250° C., and having a microstructure composed of degenerate upper bainite of more than 70%, rough rolling in a recrystallizing region, rolling in an unrecrystallization austenitic region at 900° C., or below with a cumulative rolling reduction of not less than 75% and, then, applying accelerated cooling from the austenitic region so that the center of plate thickness cools to 500° C., or below at a rate of 1 to 10° C./sec., $$P=2.7C+0.4Si+Mn+0.8Cr+0.45(Ni+Cu)+Mo-1$$

wherein the symbols of elements designate the mass % of the individual elements.

18. A method for manufacturing steel plate for ultra-high-strength linepipe having excellent low-temperature toughness described in 17, in which the relationship Ti−3.4 N>0 is satisfied (wherein the symbols of elements designate the mass % of the individual elements).

19. A method for manufacturing ultra-high-strength linepipe having excellent low-temperature toughness comprising the steps of:

forming a steel plate manufactured by the methods for manufacturing ultra-high-strength steel plate having excellent low-temperature toughness described in claim 15 into a pipe form so that the rolling direction of the steel plate agrees with the longitudinal direction of a pipe to be manufactured, and forming a pipe by seam-welding together the edges thereof.

20. A method for manufacturing ultra-high-strength linepipe having excellent low-temperature toughness comprising the steps of:

forming a steel plate manufactured by the methods for manufacturing ultra-high-strength steel plate having excellent low-temperature toughness described in claim 15 into a pipe form by the UO process so that the rolling direction of the steel plate agrees with the longitudinal direction of a pipe to be manufactured, forming a pipe by joining together the edges thereof by applying submerged-arc welding from both inside and outside, and expanding the welded pipe.

21. A method for manufacturing ultra-high-strength linepipe having excellent low-temperature toughness comprising the steps of:

heating slabs consisting essentially of:

| | |
|---|---|
| C | 0.03 to 0.07 mass % |
| Si | not more than 0.28 mass % |
| Mn | 1.5 to 2.5 mass % |
| P | not more than 0.015 mass % |
| S | not more than 0.003 mass % |
| Ni | 0.1 to 1.5 mass % |
| Mo | 0.15 to 0.60 mass % |
| Nb | 0.01 to 0.10 mass % |
| Ti | 0.005 to 0.030 mass % |
| Al | not more than 0.06 mass % |
| and, one or more of: | |
| B | not more than 0.0025 mass % |
| N | 0.00l to 0.006 mass % |
| V | not more than 0.10 mass % |
| Cu | not more than 1.0 mass % |
| Cr | not more than 1.0 mass % |
| Ca | not more than 0.01 mass % |
| REM | not more than 0.02 mass % |
| Mg | not more than 0.006 mass % |

and the remainder being iron and unavoidable impurities and having the value P defined below being between 2.5 and 4.0 and between 1000 and 1250° C., and having a microstructure composed of degenerate upper bainite of more than 70%, rough rolling in a recrystallized region, rolling in an unrecrystallization austenitic region at 900° C., or below with a cumulative rolling reduction of not less than 75%, applying accelerated cooling from the austenitic region so that the center of plate thickness cools to 500° C. or below at a rate of 1 to 10° C./sec., forming the steel plate thus manufactured into a pipe form so that the rolling direction of the steel plate agrees with the longitudinal direction of a pipe to be manufactured, and forming a pipe by welding together the edges thereof, $$P=2.7C+0.4Si+Mn+0.8Cr+0.45(Ni+Cu)+(1+\beta)Mo-1+\beta$$

where $\beta=1$ when $B>3$ ppm and $\beta=0$ when $B<3$ ppm wherein the symbols of elements designate the mass % of the individual elements.

22. A method for manufacturing ultra-high-strength line-pipe having excellent low-temperature toughness described in claim 21, which furthermore comprising the steps of:

forming the steel plate subjected to accelerated cooling into a pipe form by the UO process so that the rolling direction of the steel plate agrees with the longitudinal direction of a pipe to be manufactured, joining the edges thereof together by applying submerged-arc welding from both inside and outside, and expanding the welded pipe.

* * * * *